US005328399A

United States Patent [19]

Reynolds

[11] Patent Number: 5,328,399

[45] Date of Patent: Jul. 12, 1994

[54] TOY ALTERABLE BETWEEN TWO DIFFERENT SHAPES

[75] Inventor: Christopher A. Reynolds, Wilton, Conn.

[73] Assignee: Environmental Preservation, Inc., Southport, Conn.

[21] Appl. No.: 30,642

[22] Filed: Mar. 12, 1993

[51] Int. Cl.[5] ..... A63H 33/00; A42B 1/20

[52] U.S. Cl. ..... 446/27; 2/209.11; 2/209.12; 273/58 R

[58] Field of Search ..... 446/26-28, 446/369, 321, 72-75; 2/209.1, 196; 273/58 R

[56] References Cited

U.S. PATENT DOCUMENTS

| | | | |
|---|---|---|---|
| D. 165,280 | 11/1951 | Goodman et al. . | |
| 2,987,318 | 6/1961 | Hammer . | |
| 3,518,785 | 7/1970 | Behr . | |
| 3,584,400 | 6/1971 | Voges . | |
| 4,080,665 | 3/1978 | Hodes | 2/209.1 |
| 4,413,442 | 11/1983 | McSweeney . | |
| 4,543,669 | 10/1985 | Katz | 446/369 X |
| 4,610,038 | 9/1986 | Dennard | 2/209.1 |
| 4,614,505 | 9/1986 | Schneider et al. | 446/372 |
| 4,620,842 | 11/1986 | Wang . | |
| 4,627,622 | 12/1986 | Spilhaus | 273/157 R |
| 4,695,264 | 9/1987 | McLeod, Jr. | 446/321 |
| 4,715,840 | 12/1987 | Swift | 446/74 |
| 4,734,075 | 3/1988 | Park | 446/321 |
| 4,842,565 | 6/1989 | VonPhilp, Sr. | 446/321 |
| 4,883,441 | 11/1989 | Byer | 446/369 X |
| 5,090,938 | 2/1992 | Reynolds | 446/369 |

FOREIGN PATENT DOCUMENTS 938100 12/1973 Canada .

*Primary Examiner*—Mickey Yu
*Attorney, Agent, or Firm*—Plevy & Associates

[57] ABSTRACT

An article is transformable from a first shape associated with an activity such as a sport or sports team to a second shape associated with that same sport or sports team and vice versa. Possible shapes include those of items of equipment used by participants in the sport, articles worn by participants in the sport, and symbols associated with a specific team engaged in the sport. The transformable article includes a first portion that is pliable and formed in the first shape and a second portion that is pliable and formed in the second shape. The portions define respective internal hollow regions and corresponding aligned apertures that provide access to the internal hollow. Each portion is collapsible so that it can be positioned within the internal hollow of the other portion.

10 Claims, 6 Drawing Sheets

TOY ALTERABLE BETWEEN TWO DIFFERENT SHAPES

FIELD OF THE INVENTION

The present invention relates generally to toy objects and, more particularly, to toy objects that can be altered to assume different shapes associated with the same activity.

BACKGROUND OF THE INVENTION

Fans attending sports events such as automobile races or baseball, hockey, and football games typically have a strong desire to show support for their favorite team. Support for a favorite team is generally demonstrated by waving banners or by wearing caps, helmets and other articles of clothing bearing a team indicia or logo. Even if they are not athletically active themselves, dedicated fans may also decorate their cars and the living areas of their homes with posters, models, toys, sports equipment, and other articles to display their affection for their favorite sport and/or sports teams.

None of the objects discussed above, however, allow the sports fan to express his or her support for the team at home or at the stadium using the shapes of two distinct objects associated with a particular sporting activity or team. The closet prior art device is disclosed in U.S. Pat. No. 5,090,938, issued also to the inventor of the present invention. In the '938 patent, there is disclosed an educational toy in which the shape, for example, of an animal can be replaced with that of a globe bearing geographical indicia reflecting the habitat of that animal. The toy is changed by pushing a portion forming one of the shapes into the internal hollow of a portion defining the other of the shapes. A closure fastener is provided for closing the aperture which provided access to the internal hollow. Though well adapted for use in an educational toy, the shapes used in the '938 patent do not suggest utilizing a common activity as the underlying basis for both shapes, nor do they address the needs of the fan to demonstrate support for a particular sport, team or athlete.

Reference to the aforementioned '938 patent will uncover cites to references disclosing other prior art toy articles adapted to assume the shape of two distinct objects. Among the references cited therein are U.S. Pat. Nos. 4,413,442, 4,614,505, 4,695,264, 4,715,840, 4,734,075, and 4,842,565. The '442 patent, for example, discloses a toy figure that can be changed from one discrete shape (e.g., an egg) to another distinct configuration (e.g., an animal such as a duck). The toy is changed by folding back the outer covering of the egg and pushing the body portion of the animal through a hole in the egg covering. The portion of the covering that has been folded back is then locked in place by hook and loop strips to maintain the article in the shape of the animal. Although the shapes of the bird and the egg disclosed in the '442 patent are conceptually related in a natural sense, there is no suggestion for providing an article which can be changed to assume the shape of two distinct objects associated with the same activity, and more particularly with the same sports activity or sports team.

It is, therefore, an object of the present invention to create a changeable toy article which is transformable from a first shape associated with a specific activity to a second shape associated with that activity.

It is another object of the present invention to allow the fan of a sports activity to demonstrate support for a particular team, sport, and/or athlete at home or at the stadium using the shapes of two distinct objects associated with that team, sport, and/or athlete.

SUMMARY OF THE INVENTION

The present invention relates to an article transformable between a first shape associated with a particular activity, such as a sports activity or event or even a sports team engaging in the same, and a second shape associated with that activity to allow a sports fan to flexibly demonstrate his or her affection therefor.

First and second shapes are each formed from respective pliable first and second portions of a resilient material such as cloth. While the article is in the first shape, the pliable portion used to form the second shape is in a collapsed condition and is stored in an internal hollow region within the first portion.

When it is desired to obtain the second shape, the second portion is extracted from the internal hollow by pulling it through an aperture in the first portion and manipulating it form the second shape. The first portion can then be inserted through an aperture in the second portion and stored in an internal hollow region within the second portion. A closing means in the form of a hook and loop fastener or zipper may be used to close the aperture.

A variety of shapes may be used in obtaining the objective of the present invention. For example, a first of the shapes may be in the form of an item of equipment used in a particular sport and a second of the shapes may be in the form of an article worn in that sport. Accordingly, the first shape may be that of a football, baseball, race car, or golf ball, respectively, while the corresponding second shape may be that of a football helmet, a baseball cap, a race car driver's helmet, or a golfer's visor. One or both of the shapes may include indicia identifying a favorite team or athlete. If desired, a shape in the form of a team symbol (e.g., an animal for which a favorite team in a league of that sport is named) may be substituted for one of the other shapes mentioned above.

DETAILED DESCRIPTION OF THE INVENTION

Figure 1:
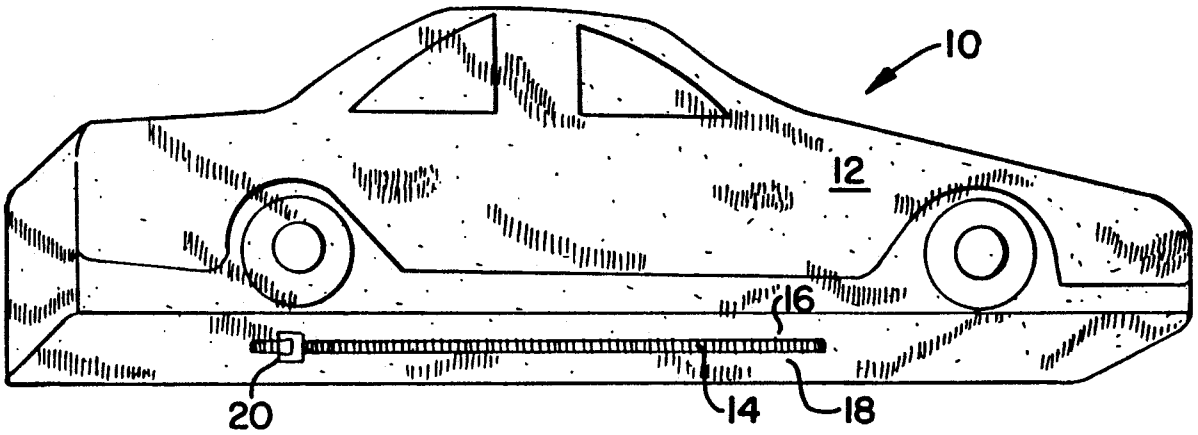
FIG. 1 is a perspective view of an article formed in accordance with the present invention and being in a first shape.

With reference now to FIG. 1, an embodiment of the present invention is illustrated in which the article 10 is in the shape of an automobile and is patterned with the particular indicia of a racing car. However, it should be readily appreciated that any shape associated with any activity, such as a sports activity or even a sports team which engages in a sports activity may be used as the basis for the first and second shapes.

The article 10 is fabricated from a portion 12 of any sufficiently pliable material. To obtain high resistance to wear and to facilitate cleaning, a resilient cloth or cloth-like material is preferred. However, depending on the texture desired, sheets of vinyl, rubber, plastic, or composites thereof may also be utilized.

An aperture 14 is formed at the exterior surface of portion 12 and has a perimeter formed by two sides 16 and 18. Aperture 14 defines an opening to the interior surface of portion 12 and provides access to an internal hollow region (not shown) formed thereby. The interior hollow region may be sealed by a closure device 20 located proximate the aperture. Any suitable closure device may, such as a zipper assembly or a hook and loop fastener, may be used.

Figure 2:
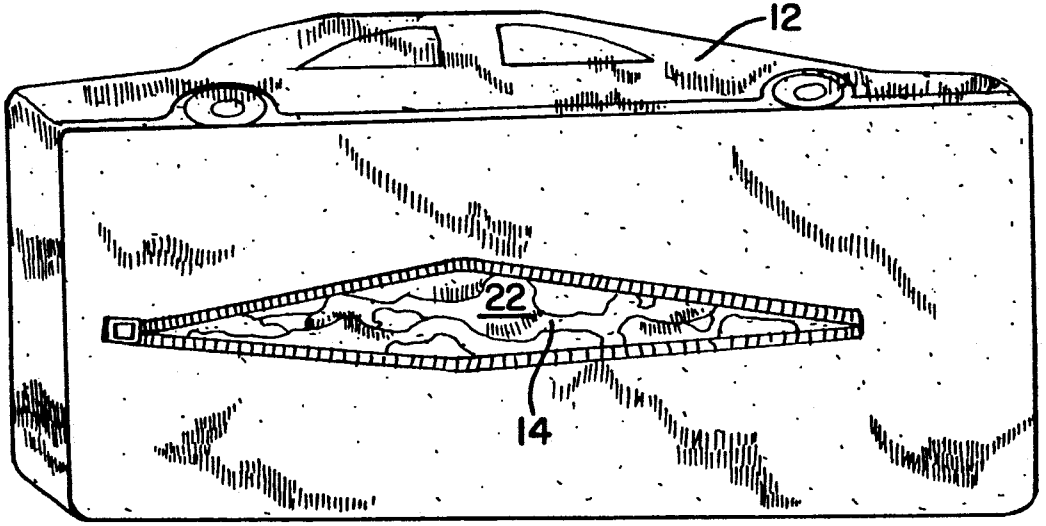
FIG. 2 is a bottom perspective view showing the article being used in the first shape.
Figure 3:
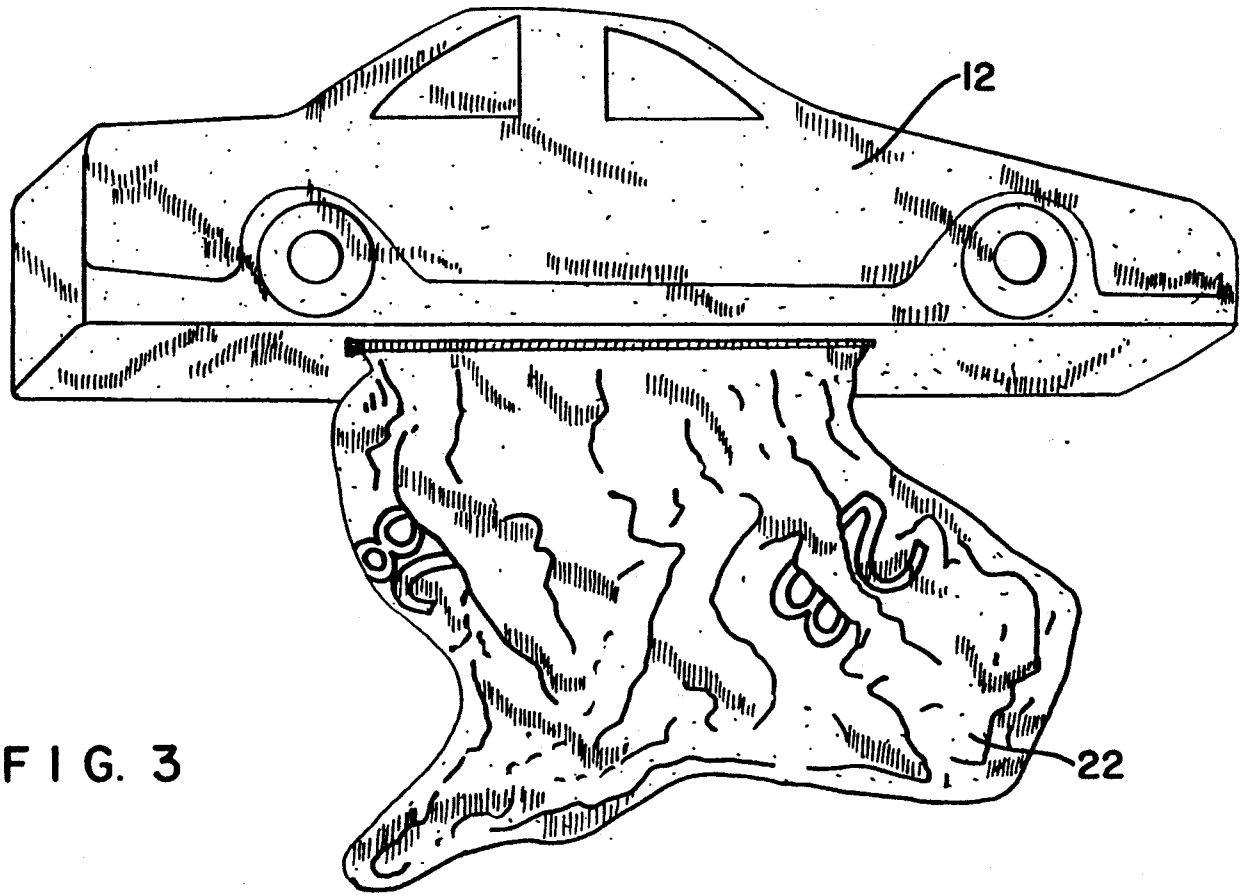
FIGS. 3 and 4 are side views of the article in FIG. 1 being manipulated to alter the first shape into a second shape.
Figure 4:
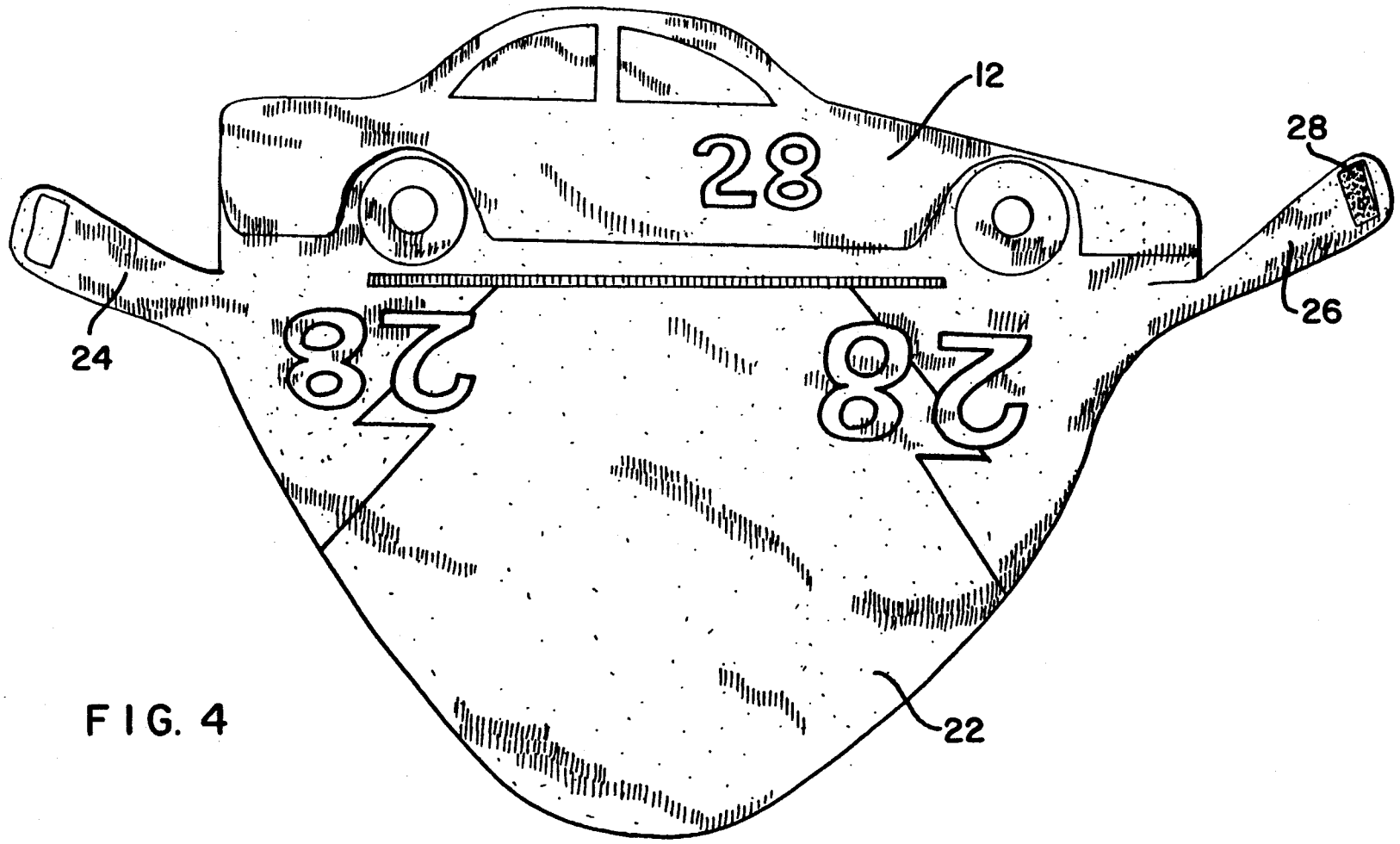

As shown in FIGS. 2–4, a second portion 22 of pliable material cloth-like material is formed in a different predetermined shape which is also associated with the same sports activity or team as the shape represented by portion 12. As more clearly shown in FIGS. 5 and 6, the second portion of the embodiment illustrated is formed in the shape of a racing car driver's helmet. To further emphasize the relationship between the first and second shapes, the exterior surface of portion 22 may be provided with indicia corresponding to the indicia formed on the exterior surface of portion 12.

Figure 5:
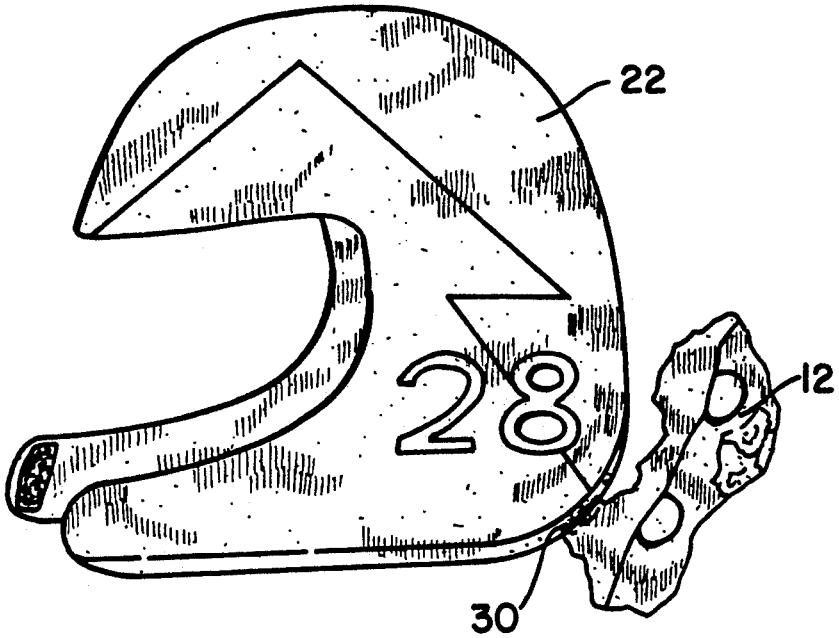
FIG. 5 is a perspective view showing the final manipulation of the article to obtain a second shape in accordance with the present invention.
Figure 6:
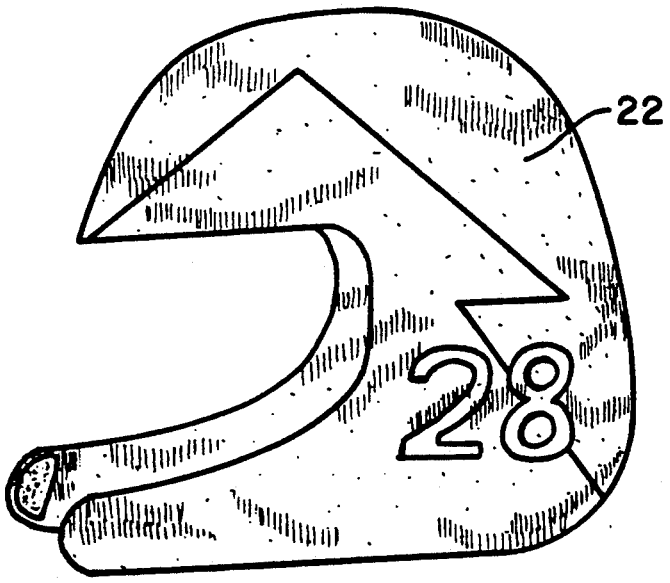
FIG. 6 is a side view of the article in a second shape in accordance with the present invention.

As indicated above, aperture 14 provides access to an internal hollow region defined by the interior surface of first portion 12. The interior surface of second portion 22 also defines an internal hollow region (not shown). As shown in FIG. 5, access to the internal hollow of the second portion is provided by a second aperture 30. The first and second portions are connected so that their respective apertures are aligned. Accordingly, when the article has been manipulated into the intermediate configuration shown in FIG. 4, the internal hollow regions of the first and second portions are in air communication with each other via the aligned apertures.

In accordance with the embodiment of FIGS. 1–6, means are provided so that the user may wear the article over his head after the article has been manipulated to assume the helmet configuration of the second shape. Specifically, and with continuing reference to FIG. 4, portion 22 includes a first strap portion 24 and a second strap portion 26 which are equipped with suitable fastening means 28, such as one or more buttons, snaps, or hook and loop fastener tabs.

With reference now to FIGS. 2–6, it can be seen that article 10 may be manipulated to change from the first shape to the second shape. To accomplish this, the user merely reaches through the aperture 14 and into the internal hollow to grasp the second portion 22. The second portion is then pulled out of the internal hollow through the aperture 14, whereupon it immediately begins to assume its predetermined shape, that of a driver's helmet. Once the second portion 22 has been extracted from the internal hollow, the first or original surface portion 12 can be inserted through aperture 30 in the second portion 22 and into the internal hollow defined therein. Because of the aligned arrangement of apertures 14 and 30, the interior hollow region within the second portion may be sealed by the aforementioned closure device 20.

As the first portion 12 is pushed through the aperture 14, the second portion 22 assumes its own predetermined shape while the first portion and its shape becomes less discernible. Eventually, portion 12 is positioned completely within the internal hollow of the second portion and only the exterior surface of the second portion remains visible.

Figure 7:
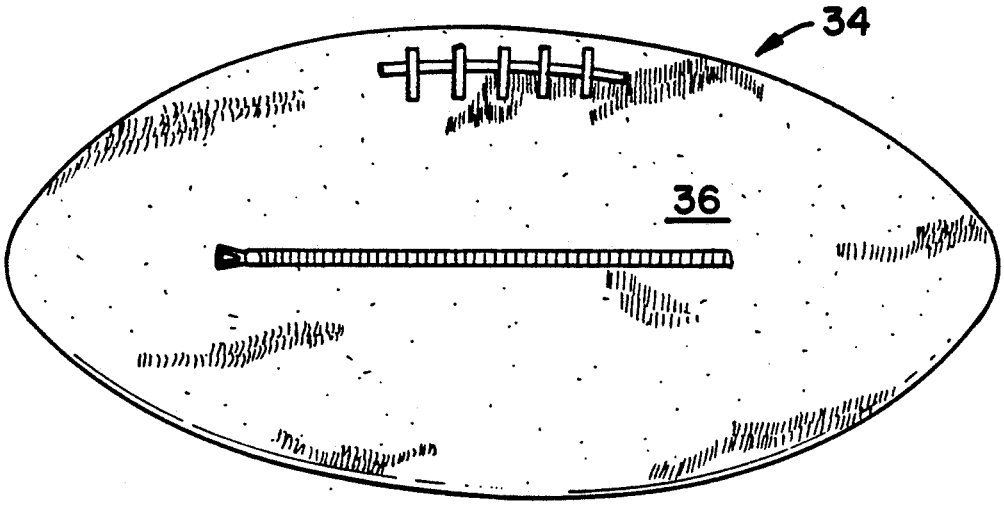
FIG. 7 is a perspective view of an article utilizing a first shape in accordance with a second embodiment of the present invention.
Figure 8:
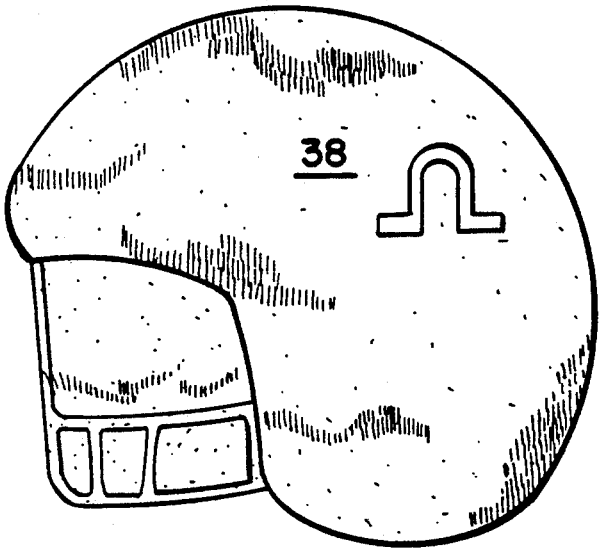
FIG. 8 is a perspective view of an article utilizing a second shape in accordance with the second embodiment.

Referring now to FIG. 7, a second illustrative embodiment of the present invention is shown, in which article 34 incorporates a first portion 36 adapted to assume the shape of an item of equipment used in a sports activity. As shown in FIG. 8, article 34 also incorporates a second portion 38 adapted to assume the shape of an article worn in the same sports activity. In the embodiment of FIGS. 7 and 8, the first shape is of a football and the second shape is of a football helmet. If desired, the football helmet may be provided with suitable indicia reflecting the favorite team of the user. It should be readily appreciated that in accordance with this embodiment, the first shape may be that of any item of equipment associated with a sports activity. For example, the first shape might take the form of a golf ball, a soccer ball, or the like. In corresponding fashion, the second shape may be of any article worn by participants in the same sports activity as that embodied by the first shape. Thus, where the first shape is a golf ball, the second shape may be a golfer's visor or similar object.

Figure 9:
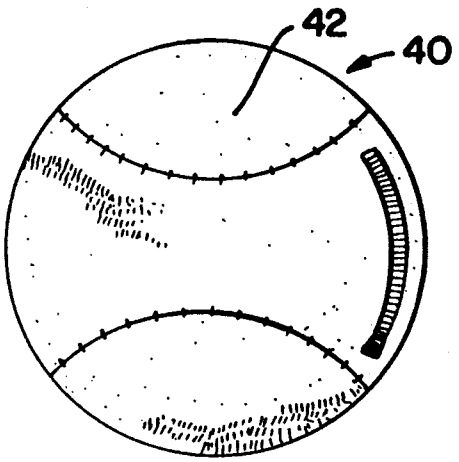
FIG. 9 is a perspective view of an article utilizing a first shape in accordance with a third embodiment of the present invention.
Figure 10:
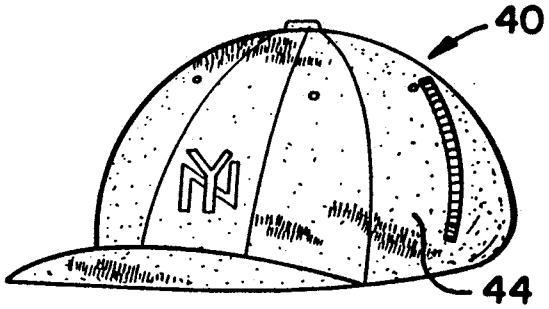
FIG. 10 is a perspective view of an article utilizing a second shape in accordance with the third embodiment.

Referring now to FIG. 9, a third illustrative embodiment of the present invention is shown, in which article 40 incorporates a first portion 42 adapted to assume the shape of a baseball. As shown in FIG. 10, article 40 also incorporates a second portion 44 adapted to assume the shape of a baseball cap worn by the user's favorite team.

Figure 11:
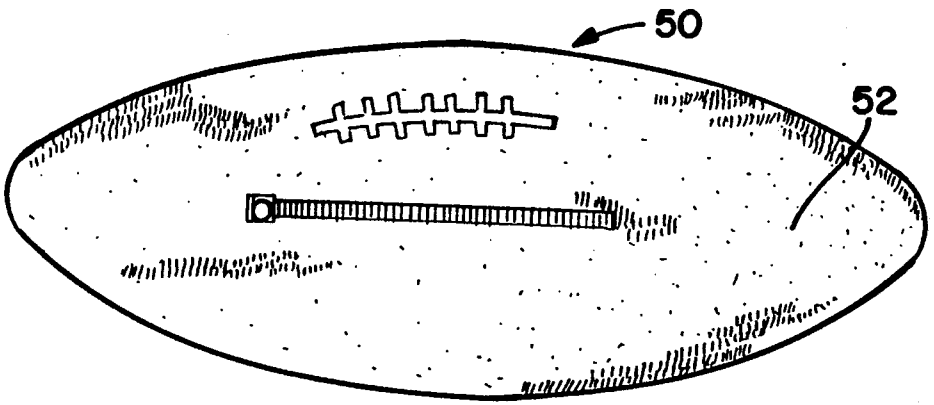
FIG. 11 is a perspective view of an article utilizing a first shape in accordance with a fourth embodiment of the present invention.
Figure 12:
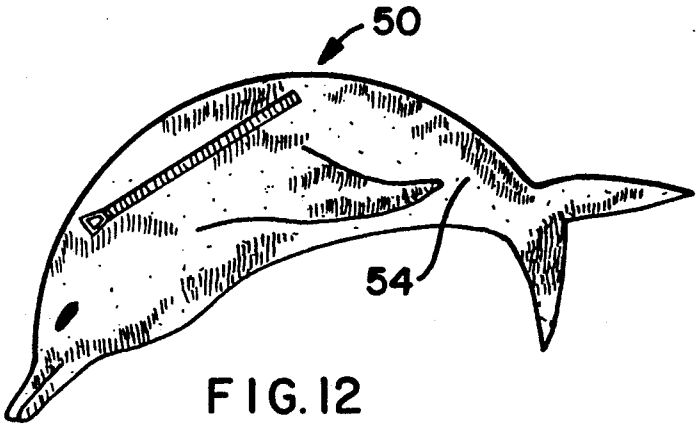
FIG. 12 is a perspective view of an article utilizing a second shape in accordance with a fourth embodiment of the present invention.

Referring now to FIG. 11, a fourth illustrative embodiment of the present invention is shown, in which article 50 incorporates a first portion 52 adapted to assume the shape of an item of equipment used in a sports activity. As shown in FIG. 12, article 50 also incorporates a second portion 54 adapted to assume the shape of a symbol or mascot of a particular team which engages in that sports activity. In the illustrated embodiment, which is adapted for use by fans of the Miami Dolphins, the first shape is of a football and the second shape is of a dolphin.

It will be understood that each of the embodiments described herein are merely exemplary and that a person skilled in the art may make many variations and modifications without departing from the scope and spirit of the invention. All such modifications are intended to be included within the scope of the invention as defined in the appended claims.

What is claimed is:

1. A toy transformable from a first shape to a second shape and vice versa, comprising:

a pliable first portion formed to assume a shape of a projectile used by persons engaging in an athletic activity, said first portion having indicia thereon representative of said projectile and defining an internal hollow and an aperture providing access to said internal hollow;

a pliable second portion formed to assume a shape of an article worn on the head of a person who engages in said athletic activity during engagement therein, said second portion being positionable within said internal hollow and being extractable from said internal hollow through said aperture, wherein upon extraction of said second portion from said internal hollow said second portion is manipulable to assume said second shape and wherein said toy is adapted to be worn on the head of a person when in said second shape, wherein said athletic activity is football, said first shape is that of a football and said second shape is that of a football helmet.

2. A toy transformable from a first shape to a second shape and vice versa, comprising:

a pliable first portion formed to assume a shape of a projectile used by persons engaging in an athletic activity, said first portion having indicia thereon representative of said projectile and defining an internal hollow and an aperture providing access to said internal hollow;

a pliable second portion formed to assume a shape of an article worn on the head of a person who engages in said athletic activity during engagement therein, said second portion being positionable within said internal hollow and being extractable from said internal hollow through said aperture, wherein upon extraction of said second portion from said internal hollow said second portion is manipulable to assume said second shape and wherein said toy is adapted to be worn on the head of a person when in said second shape, wherein said athletic activity is baseball, said first shape is that of a baseball and said second shape is that of a baseball cap.

3. A toy transformable from a first shape to a second shape and vice versa, comprising:

a pliable first portion formed to assume a shape of a projectile used by persons engaging in an athletic activity, said first portion having indicia thereon representative of said projectile and defining an internal hollow and an aperture providing access to said internal hollow;

a pliable second portion formed to assume a shape of an article worn on the head of a person who engages in said athletic activity during engagement therein, said second portion being positionable within said internal hollow and being extractable from said internal hollow through said aperture, wherein upon extraction of said second portion from said internal hollow said second portion is manipulable to assume said second shape and wherein said toy is adapted to be worn on the head of a person when in said second shape, wherein said athletic activity is golf, said first shape is that of a golf ball and said second shape is that of a golfer's visor.

4. A toy transformable from a first shape to a second shape, each of said shapes being of articles associated with a spectator sport, comprising:

a pliable first portion formed to assume a shape of an article worn by participants in said sport, said first portion defining an internal hollow and an aperture providing access to said internal hollow;

a pliable second portion formed to assume a shape of an article used by participants while engaged in said sport, said second portion being positionable within said internal hollow and being extractable from said internal hollow through said aperture, wherein upon extraction of said second portion from said internal hollow said second portion is manipulable to assume said second shape, wherein said toy is adapted to be worn on the head of a spectator watching said sport when manipulated into said first shape, wherein said sport is racing, said first shape is of a driver's helmet which may be worn by said spectator, and said second shape is of a car.

5. A toy transformable from a first shape to a second shape, each of said shapes being of articles associated with a spectator sport, comprising:

a pliable first portion formed to assume a shape of an article worn by participants in said sport, said first portion defining an internal hollow and an aperture providing access to said internal hollow;

a pliable second portion formed to assume a shape of an article used by participants while engaged in said sport, said second portion being positionable within said internal hollow and being extractable from said internal hollow through said aperture, wherein upon extraction of said second portion from said internal hollow said second portion is manipulable to assume said second shape, wherein said toy is adapted to be worn on the head of a spectator watching said sport when manipulated into said first shape, wherein said sport is football, said first shape is that of a football helmet, and said second shape is that of a football.

6. A toy transformable from a first shape to a second shape, each of said shapes being of articles associated with a spectator sport, comprising:

a pliable first portion formed to assume a shape of an article worn by participants in said sport, said first portion defining an internal hollow and an aperture providing access to said internal hollow;

a pliable second portion formed to assume a shape of an article used by participants while engaged in said sport, said second portion being positionable within said internal hollow and being extractable from said internal hollow through said aperture, wherein upon extraction of said second portion from said internal hollow said second portion is manipulable to assume said second shape, wherein said toy is adapted to be worn on the head of a spectator watching said sport when manipulated into said first shape, wherein said sport is baseball, said first shape is that of a baseball cap, and said second shape is that of a baseball.

7. A toy transformable from a first shape to a second shape, each of said shapes being of articles associated with a spectator sport, comprising:

a pliable first portion formed to assume a shape of an article worn by participants in said sport, said first portion defining an internal hollow and an aperture providing access to said internal hollow;

a pliable second portion formed to assume a shape of an article used by participants while engaged in said sport, said second portion being positionable within said internal hollow and being extractable from said internal hollow through said aperture, wherein upon extraction of said second portion from said internal hollow said second portion is manipulable to assume said second shape, wherein said toy is adapted to be worn on the head of a spectator watching said sport when manipulated into said first shape, wherein said sport is golf, said first shape is that of a golfer's visor, and said second shape is that of a golf ball.

8. A toy according to claim 1, wherein said second portion includes indicia formed thereon identifying a football team.

9. A toy according to claim 2, wherein said second portion includes indicia formed thereon identifying a baseball team.

10. A toy according to claim 3, wherein said second portion includes indicia formed thereon identifying a participant is said athletic activity.

* * * * *